US010856603B2

(12) United States Patent
MacPhail et al.

(10) Patent No.: US 10,856,603 B2
(45) Date of Patent: Dec. 8, 2020

(54) FOOTWEAR FOR USE IN SPECIALIZED ACTIVITIES

(71) Applicant: Equipower Sports Ltd. (0930496 BC Ltd.), Vancouver (CA)

(72) Inventors: David Michael MacPhail, Whistler (CA); Stephen G. Podborski, Vancouver (CA); Thomas Blaine Hoshizaki, Rockcliffe Park (CA); Michel Joseph Chiasson, Saint Lambert (CA)

(73) Assignee: Equipower Sports, Ltd., Westmount (CA)

( * ) Notice: Subject to any disclaimer, the term of this patent is extended or adjusted under 35 U.S.C. 154(b) by 0 days.

(21) Appl. No.: 15/145,255

(22) Filed: May 3, 2016

(65) Prior Publication Data

US 2016/0242494 A1 Aug. 25, 2016

Related U.S. Application Data

(62) Division of application No. 13/997,797, filed as application No. PCT/CA2012/050890 on Dec. 12, 2012, now abandoned.

(60) Provisional application No. 61/569,947, filed on Dec. 13, 2011.

(51) Int. Cl.

| | |
|---|---|
| ***A43B 3/26*** | (2006.01) |
| ***A43B 7/14*** | (2006.01) |
| ***A43B 7/18*** | (2006.01) |
| ***A43B 5/14*** | (2006.01) |
| *A43B 5/00* | (2006.01) |

(52) U.S. Cl.

CPC ..... *A43B 3/26* (2013.01); *A43B 5/14* (2013.01); *A43B 7/14* (2013.01); *A43B 7/144* (2013.01); *A43B 7/149* (2013.01); *A43B 7/1415* (2013.01); *A43B 7/1465* (2013.01); *A43B 7/18* (2013.01)

(58) Field of Classification Search

CPC .. A43B 5/14; A43B 7/14; A43B 7/141; A43B 7/143; A43B 7/144; A43B 7/1415; A43B 7/142; A43B 7/1435; A43B 7/18

USPC ..... 36/97, 131, 150, 155, 91, 166, 145, 160

See application file for complete search history.

(56) References Cited

U.S. PATENT DOCUMENTS 899,367 A * 9/1908 Winohell ..... A43B 7/1465 36/156
941,464 A * 11/1909 Rice ..... A43B 7/142 36/155

(Continued)

FOREIGN PATENT DOCUMENTS

| | | |
|---|---|---|
| EP | 1093730 | 4/2001 |
| WO | WO2008/130401 | 10/2008 |

*Primary Examiner* — Anne M Kozak

(74) *Attorney, Agent, or Firm* — Fisherbroyles, LLP; Keats Quinalty

(57) ABSTRACT

Footwear for use during a specialized activity such as skiing, cycling, skating and many other sports or industrial uses, and provides a dorsal element engaging the dorsal aspect of the foot for enabling the user to control relative to the plantar aspect the maximum height of the arch of the foot at substantially all times during the activity regardless of the position or orientation of the foot. A pivotal arm is mounted on a frame attached to the planter aspect for pivotal movement about an axis transverse to the foot and is compressed by an adjustable element operable by the user.

20 Claims, 9 Drawing Sheets

(56) References Cited

U.S. PATENT DOCUMENTS 1,242,317 A * 10/1917 Boyajian ..... A43B 7/1465 36/156
1,523,353 A * 1/1925 Winchell ..... A43B 7/1465 36/156
2,036,890 A * 4/1936 Slater ..... A43B 7/142 36/180
2,295,364 A * 9/1942 Skorepa ..... A43B 7/1465 36/156
2,297,552 A * 9/1942 Hansen ..... A43B 23/227 36/150
2,726,413 A * 12/1955 Williams ..... A43B 7/1465 12/103
3,586,003 A * 6/1971 Baker ..... A43B 7/1495 36/145
4,731,940 A * 3/1988 Zanatta ..... A43B 7/1465 36/117.5
4,741,465 A 5/1988 Johnson
4,788,782 A * 12/1988 Pozzebon ..... A43B 5/0447 36/117.9
4,909,768 A * 3/1990 O'Brien ..... B63B 35/812 36/157
4,941,272 A * 7/1990 Allen ..... A43B 21/30 36/145
4,949,479 A * 8/1990 Ottieri ..... A43B 5/0435 36/117.1
5,251,508 A * 10/1993 Robbins ..... A43B 5/14 36/131
5,265,350 A * 11/1993 MacPhail ..... A43B 5/00 36/117.9
5,285,584 A * 2/1994 Dubner ..... A43B 7/28 36/145
5,323,549 A * 6/1994 Segel ..... A43B 7/1495 36/140
5,556,123 A * 9/1996 Fournier ..... A63C 10/04 280/14.24
5,659,949 A * 8/1997 Ohba ..... H01R 43/052 29/748
5,687,492 A * 11/1997 Muraoka ..... A43B 5/14 36/11.5
5,694,703 A * 12/1997 Diaz ..... A43B 3/163 36/7.1 R
5,713,143 A * 2/1998 Kendall ..... A43B 7/14 36/145
5,791,021 A * 8/1998 James ..... A43C 1/003 24/68 SK
5,903,985 A * 5/1999 DeMarchi ..... A43B 7/1465 36/150
6,065,770 A * 5/2000 Hansen ..... A63C 10/04 280/14.21
6,178,665 B1 * 1/2001 MacPhail ..... A43B 5/0443 36/117.1
6,301,807 B1 * 10/2001 Gardiner ..... A61F 5/14 36/155
6,345,455 B1 * 2/2002 Greer, Jr. ..... A61F 5/14 36/145
6,393,733 B1 * 5/2002 London ..... A43B 7/1495 36/155
6,393,736 B1 * 5/2002 Greer, Jr. ..... A61F 5/14 36/145
6,438,872 B1 * 8/2002 Chil ..... A43B 1/0072 36/102
6,557,271 B1 * 5/2003 Weaver, III ..... A43B 3/0063 36/144
6,609,314 B1 * 8/2003 Dubner ..... A43B 7/144 36/150
6,925,734 B1 * 8/2005 Schaeffer ..... A43B 7/1495 36/166
6,938,913 B2 * 9/2005 Elkington ..... A63C 10/04 280/607
6,945,543 B2 * 9/2005 De Bortoli ..... A63C 10/04 280/14.21
7,207,592 B2 * 4/2007 Pascal ..... A63C 10/04 280/14.24
7,533,478 B2 * 5/2009 Bird ..... A43B 5/14 36/131
7,823,299 B1 * 11/2010 Brigham ..... A43B 3/105 36/100
8,065,933 B2 * 11/2011 Coderre ..... B62M 3/086 36/131
2004/0128863 A1 * 7/2004 Hong ..... A43B 3/24 36/100
2005/0066424 A1 3/2005 Salazar
2005/0223466 A1 10/2005 Jennings
2005/0240139 A1 * 10/2005 Bushby ..... A43B 7/142 602/61
2006/0137217 A1 * 6/2006 Asmundson ..... A43B 13/182 36/7.8
2006/0283051 A1 * 12/2006 Andreoli ..... A43B 7/1495 36/145
2006/0288610 A1 * 12/2006 Laska ..... A43B 3/102 36/11.5
2007/0074430 A1 * 4/2007 Coomer ..... A61F 5/0104 36/145
2007/0107264 A1 * 5/2007 Meschter ..... A43B 5/12 36/76 R
2007/0107265 A1 * 5/2007 Mueller ..... A43B 13/141 36/91
2007/0283594 A1 * 12/2007 Sink ..... A43B 3/122 36/11.5
2007/0283597 A1 * 12/2007 Logan ..... A61F 5/0111 36/91
2008/0073393 A1 3/2008 Soderquist
2008/0127526 A1 * 6/2008 Spicer ..... A43B 7/1495 36/145
2008/0178493 A1 7/2008 Scofield
2008/0216357 A1 * 9/2008 Fogg ..... A43B 3/128 36/25 R
2009/0025117 A1 1/2009 French
2009/0076772 A1 3/2009 Hinshaw
2010/0017943 A1 1/2010 Morales
2010/0064550 A1 * 3/2010 Kahn ..... A43B 3/0031 36/91
2010/0101112 A1 * 4/2010 Powaser ..... A43B 1/0072 36/43
2011/0030126 A1 2/2011 French
2011/0041360 A1 * 2/2011 Torrance ..... A43B 3/0031 36/91
2011/0047826 A1 * 3/2011 Rosen ..... A43B 3/14 36/97
2011/0061146 A1 3/2011 Spiewak
2011/0131836 A1 * 6/2011 McKay ..... A43B 7/141 36/88
2011/0203137 A1 * 8/2011 Long ..... A43B 5/12 36/91
2012/0117713 A1 5/2012 Hoffner
2012/0124860 A1 * 5/2012 Waddel ..... A43B 3/128 36/11.5
2012/0152995 A1 6/2012 Wilson
2012/0216429 A1 * 8/2012 Bastida ..... A43B 3/244 36/25 R
2012/0317834 A1 * 12/2012 Thomas ..... A43B 3/128 36/11.5
2013/0014409 A1 * 1/2013 Chouinard ..... A43B 5/18 36/59 R
2013/0112722 A1 * 5/2013 Detry ..... F41C 33/0236 224/243
2014/0059887 A1 * 3/2014 Lawlor ..... A43B 3/26 36/83

* cited by examiner

FOOTWEAR FOR USE IN SPECIALIZED ACTIVITIES

This application is a divisional application of application Ser. No. 13/997,797 filed Jun. 25, 2013;

which is a 371 of PCT application PCT/CA2012/050890 filed Dec. 12, 2012.

This application claims the benefit under 35 USC 119(e) of Provisional Application 61/569,947 filed Dec. 13, 2011.

This invention relates to footwear for use in specialized activities such as sports and industrial purposes where a specific performance of the foot of the user is required.

Structures which artificially induce specific physiologic effects in the human lower limbs in a non-invasive manner are unknown in the prior art.

The structures of the present invention enable the user to control the maximum height of the arch of the foot and, in so doing, to control the degree of functional compression/tension and the associated degree of rigidity in the three-dimensional vault of the arch of the foot. In the absence of extrinsic influences, Intrinsic physiological processes in the human system define the functional specification and operational limits of the three-dimensional arch of the foot by acting to control its maximum and minimum heights. In enabling the user to control the maximum height of the arch of the foot it is intended that intrinsic physiological processes act to control the minimal height of the arch of the foot. The primary contributor to functional tension in the arch of the foot when in a state of functional compression is the plantar aponeurosis. Although there are references in the literature that relate the arch of the human foot to the structure of an architectural truss, no references are known which describe the process by which physiologic processes render the foot into varying degrees of rigidity by altering the laxity between the joints of the hard tissue that comprise the arch of the foot.

In view of this, it would not be obvious to anyone that such states can be induced artificially through the use of non-invasive structures, or that there would be any use for such structures.

The ability to control the maximum height of the arch of the foot and, in so doing, artificially control the degree of functional compression/tension in the arch is the underpinning of the ability to artificially induce physiologic processes that render the function of the human lower limbs specific to activities such as skating, cycling, skiing and many other sports and industrial uses. Enabling the user to control the maximum height of the arch of the foot by association enables the user to alter the functional specification and operational limits of not only the foot but the lower limb.

As disclosed herein, there is provided an arrangement to enable the user to control the maximum height of the arch of the foot which is employed in conjunction with other structures of the arrangement to induce specific physiologic processes in the foot wherein the foot is firmly restrained within the elements of the invention by the intrinsic state of functional compression/tension in the arch of the foot. An increase in the degree of functional compression/tension acts to increase the degree of rigidity in the arch of the foot for up to 100% of the activity. This is particularly applicable to activities such as cycling where it is desirable to maximise the degree of rigidity in the arch of the foot for substantially 100% of the crank revolution for the purpose of transferring force from the long bones of the lower limb (femur, tibia) through the structures of the arch of the foot to the heads of the metatarsals and from there to the crank spindle.

In addition, the maximal degree of rigidity of the arch associated with controlling its maximum height in combination with an elevation of the calcaneus above the plane contacting the heads of the metatarsals acts to align the axis of the ankle joint with the axis of the crank pedal spindle which substantially maximises the transfer of force from the long bones of the lower limb to the bicycle crank.

The arrangement disclosed herein provides a minimum structure and arrangement required to enable the user to control the degree of rigidity in the arch of the human foot in a non-invasive manner by enabling the user to control the maximum height of the arch of the foot with minimal interference with associated functions of the foot, including but not limited to, blood vessels, muscles, ligaments and nerves.

The arrangement disclosed herein further provides a closed system by which the user may control the maximum height of the three-dimensional tripod-like vault of the arch of the human foot. The arrangement disclosed herein further provides a single structure having a mono-planar aspect for the plantar surface of the foot with an upwardly and rearwardly extending aspect terminating at a point on the dorsum of the foot above the mono-planar aspect in the proximate location of the apex of the vault of the arch of the foot of a user or another designated reference point within the three-dimensional vault of the arch.

The following definitions are used herein:

Plantar Surfaces

Mono-planar surfaces are used as a standardized starting point for the plantar and heel stop elements. As will become evident, adding additional surfaces to the plantar surface of the plantar element in conjunction with controlling the maximum height of the arch of the foot can influence or 'control' the function of the foot and, by association, the function of the lower limb. Adding additional surfaces and pivoting means to the heel stop element is done as required to adapt its function to the intended application.

Arch Height

In order to ensure consistency with regard to references to arch height, for the purpose of the invention 'height of the arch' or 'arch height' means the height of the arch of the foot of a user as defined by; the shortest distance between a plane defined by joining the points of the plantar aspect of the foot under the heads of the first and fifth metatarsals and the calcaneus to the dorsal surface of the foot above the proximate location of the medial cuneiform. This definition should be used in stating the effects of structures of the invention that act to control the maximum height of the arch of the foot. The specialized activities referred to herein can be any activity undertaken by the lower limb of the user for applying force from the lower limb to an element to be activated such as in cycling, skating, skiing, and many other sports and industrial uses where the forces from the lower limb are intended to be directed and controlled.

According to one aspect of the invention there is provided footwear for use during specialized activity by a user, the footwear comprising:

elements for engaging the foot of the user;

elements for engaging elements to be used in the activity;

a device to enable the user to control the maximum height of the arch of the foot;

wherein the device is arranged to enable the user to control the maximum height of the arch at substantially all times during the activity regardless of the position or orientation of the foot.

Preferably the device is arranged to enable the user to control the maximum height of the arch of the foot at substantially all orientations and positions of the foot relative to the elements to be used in the activity.

Preferably the activity is cycling and the footwear engages a pedal or crank of the cycle and the device is arranged to enable the user to control the maximum height of the arch of the foot at substantially all positions of the crank.

Preferably the device includes an element for engaging the plantar contact points of the foot and an element for contact with the dorsum of the foot.

Preferably the element for engaging the dorsum of the foot includes an arm which is rotatable to facilitate adjustment of the maximum height of the arch of the foot.

Preferably the device includes elements engaging the plantar contact points of the foot and elements providing contact with the posterior aspect of the dorsum of the foot.

As used herein, the "dorsum of the foot" pertains to the superior surface anterior of the tibia so that both the mid-foot and fore-foot constitute the dorsum which is the area facing upwards while standing. Thus the posterior aspect is the rearmost superior surface.

Preferably the arm is pivotal about an axis substantially parallel to the transverse axis of the plantar element so that the force applied thereby is substantially perpendicular to the transverse axis of the plantar element.

Preferably as a result of the user controlling the maximum height of the arch of the foot, physiologic effects render the foot into various degrees of rigidity by influencing laxity between the joints of the hard tissue that comprise the arches of the foot.

Preferably the device is arranged such that the force applied to the dorsum of the foot is substantially perpendicular to the transverse axis of the plantar element.

Preferably the device has not more than two elements where a first element of the device is disposed on the plantar aspect of the foot and a second element of the device is disposed on the dorsal aspect of the foot.

Preferably the device includes an inclined rear stop element for contact with the posterior aspect of the heel of the user.

According to a second aspect of the invention there is provided footwear for use during a specialized activity by a user, the footwear comprising:

elements for engaging the foot of the user;

elements for engaging elements to be used in the activity;

a device to enable the user to control the maximum height the arch of the foot wherein the device includes an element for engaging the plantar contact points of the foot and an element for contact with the dorsum of the foot;

According to a third aspect of the invention there is provided footwear for use during a specialized activity by a user, the footwear comprising:

elements for engaging the foot of the user;

elements for engaging elements to be used in the activity;

a device to enable the user to control the maximum height of the arch wherein the elements for engaging the dorsum of the foot include an arm which is rotatable to facilitate adjustment of the maximum height of the arch;

and wherein the arm is pivotal about an axis substantially parallel to a transverse axis of the plantar element so that the force applied thereby is substantially perpendicular to the transverse axis of the plantar element According to a fourth aspect of the invention there is provided footwear for use during specialized activity by a user, the footwear comprising:

elements for engaging the foot of the user;

elements for engaging elements to be used in the activity;

a device to enable the user to control the maximum height the arch of the foot. wherein the device includes an element for engaging the plantar contact points of the foot and an element for contact with the dorsum of the foot;

and wherein the device is arranged such that the force applied to the dorsum of the foot is substantially perpendicular to the transverse axis of the plantar element.

The posterior aspect of the dorsal element of the device, is configured so when the foot of a user is operationally engaged with the plantar element of the invention and the dorsum of the foot is in contact with the dorsal element of the invention the user is able to control the maximum height of the arch. In operation the user positions their foot on the plantar element and operates the adjustment means as necessary in order to achieve the desired maximum height of the arch of the foot.

The invention herein can also be expressed as a method where, during a specialized activity by a user, the maximum height of the arch of the foot is controlled by the user at substantially all times during the activity regardless of the position or orientation of the foot. That is, the maximum height of the arch of the foot is maintained at a value less than that when the foot is unweighted and the maximum height of the arch of the foot is controlled exclusively by intrinsic physiological processes. That is the maximum height of the arch of the foot is controlled at substantially all orientations and positions of the foot of the user relative to the elements to be used in the activity and the control is effected by the user independent of intrinsic physiological processes.

For example, when the activity is cycling and the footwear engages a pedal or crank of the cycle the device is arranged to enable the user to control the maximum height of the arch of the foot at substantially all positions of the crank.

This action of controlling the maximum height of the arch of the foot is also useful in skiing where a ski boot configured to use the device is arranged to apply force to the dorsal aspect of the foot of the user relative to the plantar surface so as to maintain a state of functional compression in the arches of the foot at substantially all times during the skiing activity.

The invention operates by inducing specific physiologic effects that render the foot into various degrees of rigidity by reducing laxity between the joints of the hard tissue that comprise the arch of the foot. That is, reducing the maximum height of the arch acts to reduce the laxity of the joints of the arch of the foot for up to 100% of the time of the activity.

An inclined rear stop element is also used for the posterior aspect of the heel of the user.

BRIEF DESCRIPTION OF THE DRAWINGS

One embodiment of the invention will now be described in conjunction with the accompanying drawings in which:

FIGS. 6 and 7 show isometric views of a schematic illustration according to the present invention for attachment to equipment such as skates, a bicycle pedal or the like.

In the drawings like characters of reference indicate corresponding parts in the different figures.

DETAILED DESCRIPTION

The invention herein may consist of two principle elements each with separate but complimentary functions and two secondary elements which are integrated with either or both of the principle elements. With reference to the two primary elements, the first element is an exoskeleton that serves as both a maximum arch height controller and a three-dimensional, tri-reaction point, force transfer system.

Heel and dorsal elements act as both force transfer interfaces and locators of the heel and dorsal spine of the foot. Each element has an outer aspect and an inner aspect which either integrate as a unit or are combined as separate elements with either the exoskeleton or footwear/liner systems.

The primary form of the invention is an exoskeleton for enabling the user to control the maximum height of the arch with a heel stop element HS at the rear end. The exoskeleton aligns key structures of the foot in relation to sports equipment such as skis, ice blades and bicycle pedal spindles and facilitates the exchange of three-dimensional forces. The starting point for the base or plantar element P is a uniform thickness, mono-planar surface with zero inclination. Structures are added to the plantar element as necessary in order to induce specific physiologic effects related to the target activity.

A footwear/liner system provides protection from the elements, comfort, and aesthetic properties.

FIGS. 1 to 5 show that the dorsal element D1 is brought into contact with the foot along a predetermined path PD that is substantially perpendicular to the transverse aspect of the foot surface of the plantar element P. The path can be linear or an arc pivotal about a transverse axis as shown in the embodiment of FIGS. 6 to 9.

The means to bring the dorsal element into contact with the foot of a user causes both elements to act in concert to control the maximum height of the arch of the foot. However, it is easier to visualise the dorsal element 12 as the active element.

Figure 6:
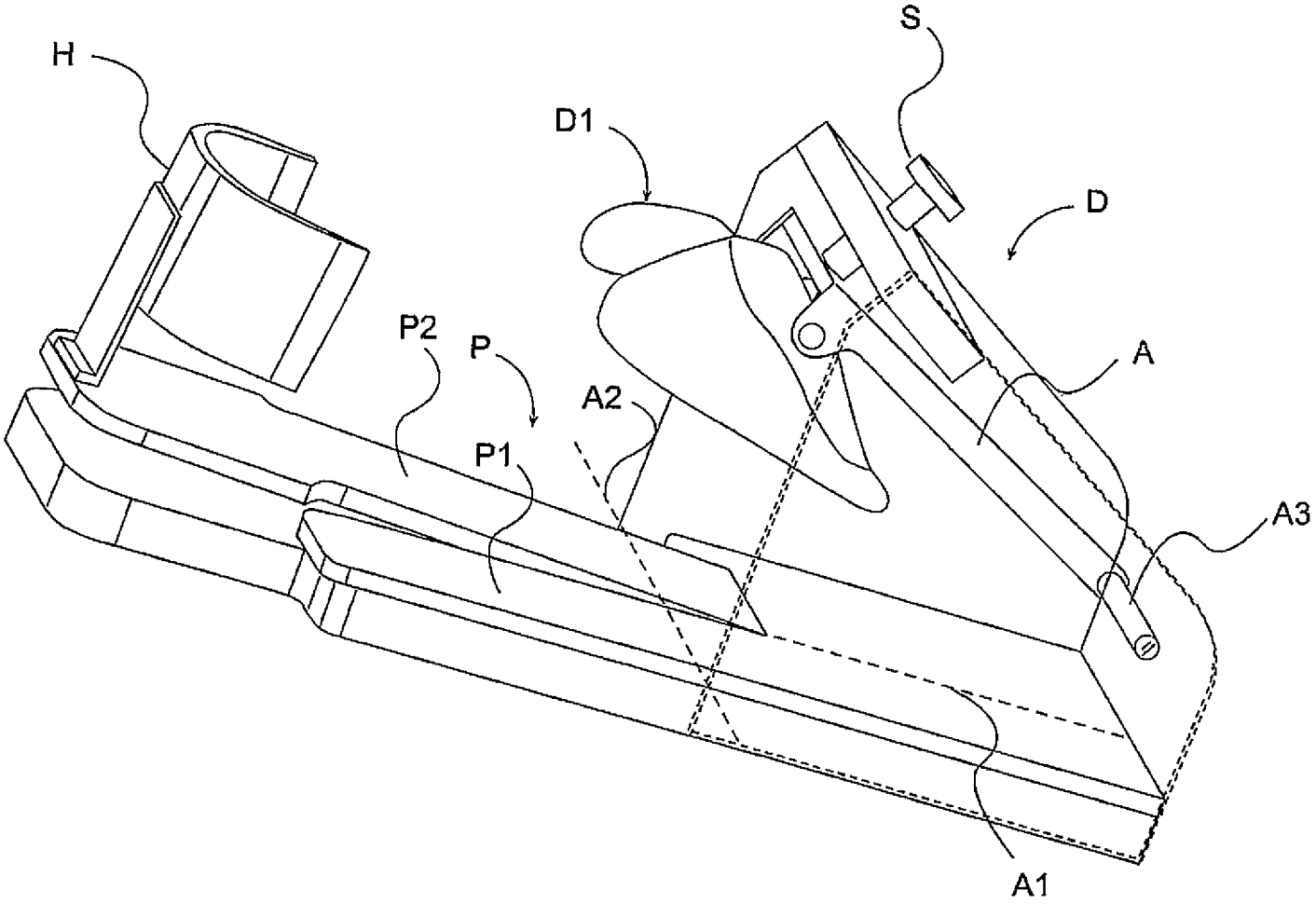
Figure 7:
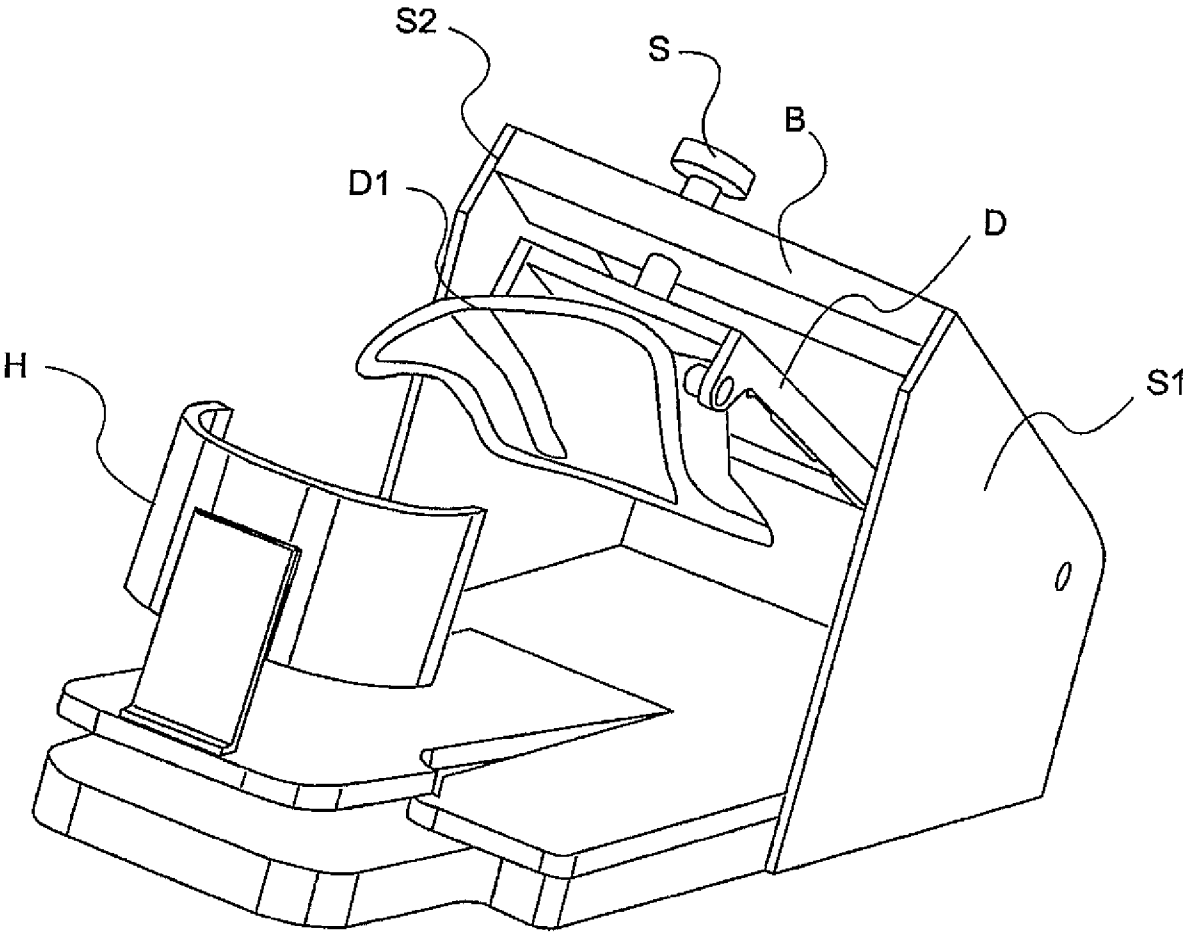

FIGS. 6 and 7 show a prototype with a rotatable arm A to carry the dorsal element D1 which is pivotally connected to the arm. A threaded rotatable screw S mounted on the arm applies tension acting on the dorsal element which enables the user to continually adjust the angle of the arm A with the plantar element P so as to control the maximum height of the arch of the foot of the user. The dorsal element D1 is in a form which is arched so as to be generally following the shape of the dorsum of the foot in the area where force is applied. Although this is a preferred embodiment, the form of the dorsal element D1 is not essential to effecting control of the maximum height of the arch of the foot.

The important differentiation of the embodiment shown in the two figures from structures of the prior art is that the invention enables the user to control the maximum height of the arch of the foot. This is accomplished by adjusting the height of the dorsal element D1 above the plantar element P as necessary to obtain the desired maximum height of the arch of the foot.

It is also important to note that only these two elements D1 and P, properly configured, are required to enable the user to control the maximum height of the arch of the foot. The CAD model of FIGS. 8 and 9 shows the means used to move the dorsal element so it controls the maximum height of the arch of the foot.

In FIGS. 6 and 7 there is shown a structure for enabling the user to control of the maximum height of the arch of the foot. It will be noted that this includes a plantar plate P including a front section P1 and an inclined rear section P2. The dorsal section D includes a plate D1 shaped to overlie the arch of the foot of the user with the plate D1 mounted on an arm A pivotal about an axis A3 parallel to the transverse axis A2. The position of the plate is adjustable by a screw S which operates to press down on the plate D1 from a fixed bar B connected to the plantar plate P by side walls S1 and S2. A heel cup H is carried at the rear of plate P2.

Figure 8:
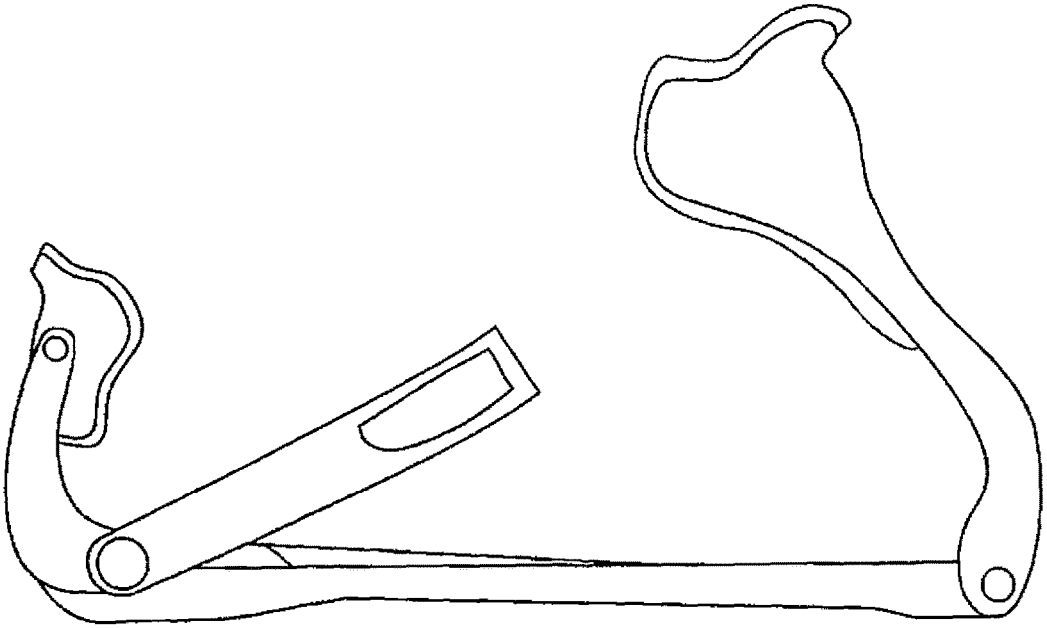
FIGS. 8 and 9 show side elevational views of a typical arrangement according to the present invention in open and closed positions.
Figure 9:
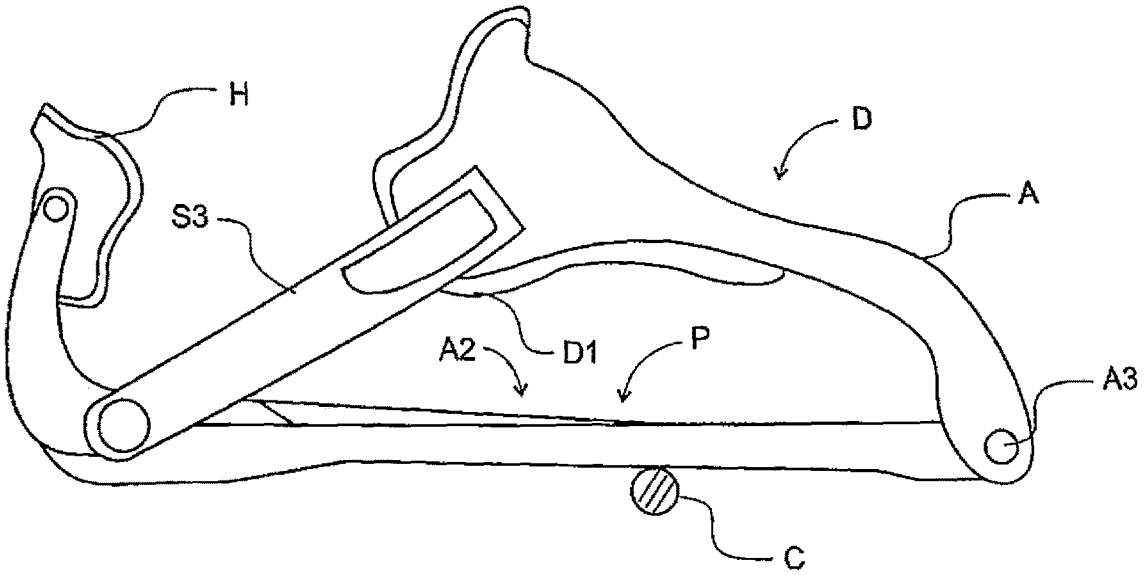

In FIGS. 8 and 9 there is shown a similar structure for enabling the user to control the maximum height of the arch of the foot. It will be noted that this includes a mono-planar plantar element P attached directly to a crank C or pedal of a bicycle with an inclined heel portion P1. The dorsal element D includes the arm A pivotally connected to the plantar element P with a secondary element D shaped to overlie the arch of the foot of the user with the dorsal element D1 mounted on the arm A which is pivotal about an axis A3 which is substantially parallel to the transverse axis A2. The position of the arm A is adjustable by a Strap S3 which operates to pull down on the arm A from the plantar element P. A heel cup H is carried at the rear of plate P. The strap S3 is adjustable in length to control the spacing between the dorsal plate D1 and the plantar element P.

The invention therefore provides a device for enabling the user to control the maximum height of the arch of the foot. The device consists of a single structure having not more than two elements, each element for contact with at least one aspect of the foot of a user. A first element of the device is disposed on the plantar aspect of the foot and a second element of the device disposed on the dorsal aspect of the foot, the two elements are configured with each other so that when the foot of a user is operationally engaged in the device the user is able to control the maximum height of the arch of the foot. However some arrangements may be provided which use more than two elements to create the same effect.

The point of specifying not more than two elements with one plantar element and one dorsal element is to limit the general maximum arch height adjustment mechanisms to two. Having a third aspect on another aspect of the foot such as a medial first metatarsal does not detract from the effect.

In operation the user positions their foot on the plantar element of the device and operates the adjustment means until the desired maximum height of the arch is achieved.

With regard to the height between the plantar and dorsal elements of the invention in relation to the height of the arch of the foot of a user, when the surface of the plantar element is mono-planar the plane defined by the plantar aspect of the foot under the heads of the first and fifth metatarsals and calcaneus will be congruent with the surface of the plantar element. However, when the plantar aspect of the foot is in contact with more than one plane, as it is in FIG. 3, where the heel sits on a heel platform HP the dimension between a point on the dorsal element and a point on the plantar element would be greater than the same distance related to the height of the arch. Accordingly the method of determining arch height is standardized to references in the foot and refers to the effect of the invention on arch height when the foot is operationally positioned. The effect of arch height of the invention should take precedence over the physical differences in height between the surfaces of the plantar and dorsal elements.

Figure 5:
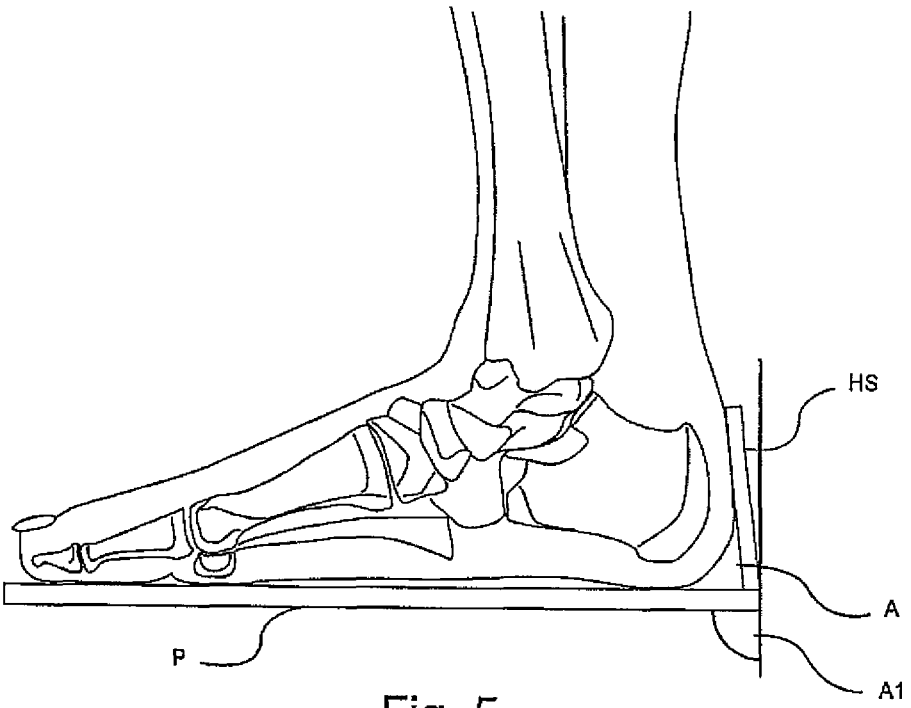

As shown in FIG. 5, there is provided an inclined rear stop element for the posterior aspect of the heel of a user. The device consists of a substantially mono-planar inclined upstanding structure for contact with at least a portion of the posterior aspect of the heel of a user. The device is affixed to the rear aspect of the base element with the inclined aspect of the device being arranged at an angle A anteriorly less than angle A1 ninety degrees but greater than forty-five degrees in relation to the transverse aspect of the plantar element at the position of attachment.

Figure 1:
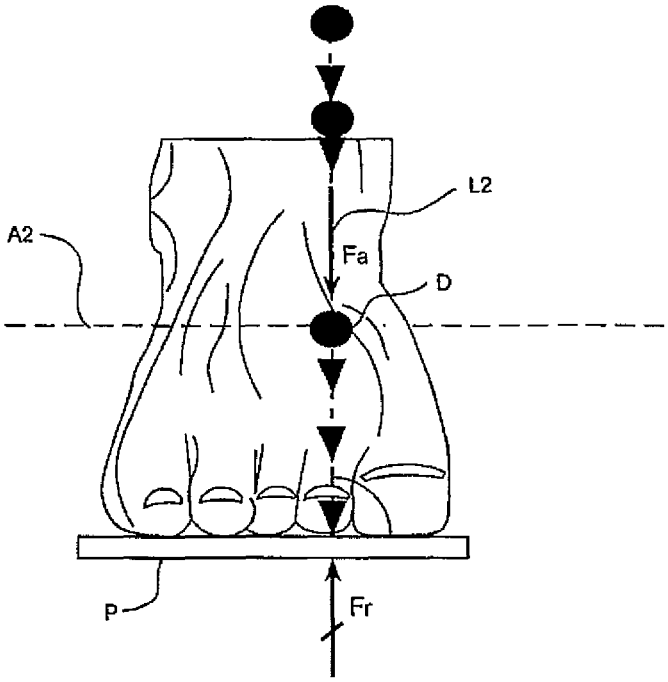
FIGS. 1 to 5 show a schematic illustration of the foot of the user when using the arrangement according to the present invention.
Figure 2:
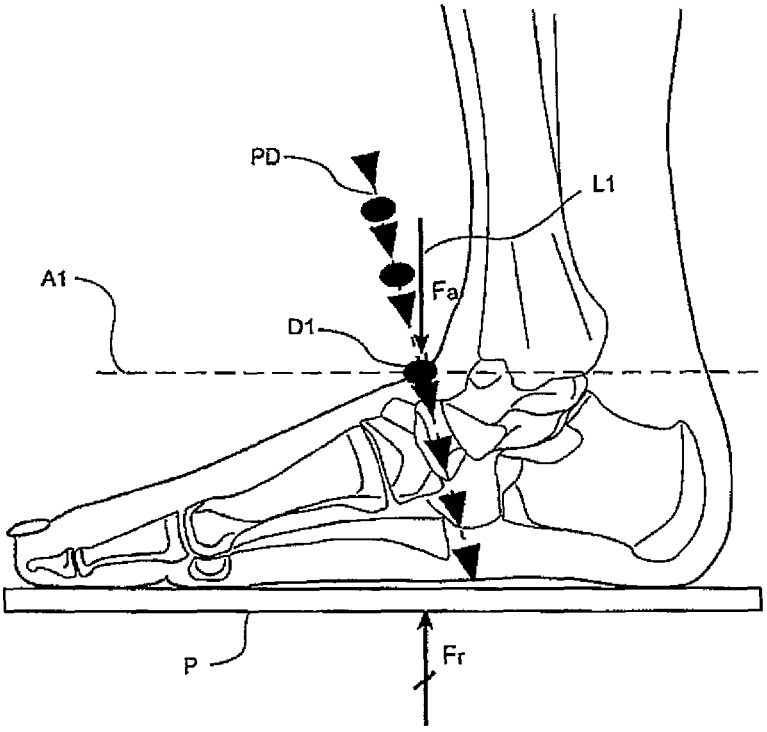
Figure 3:
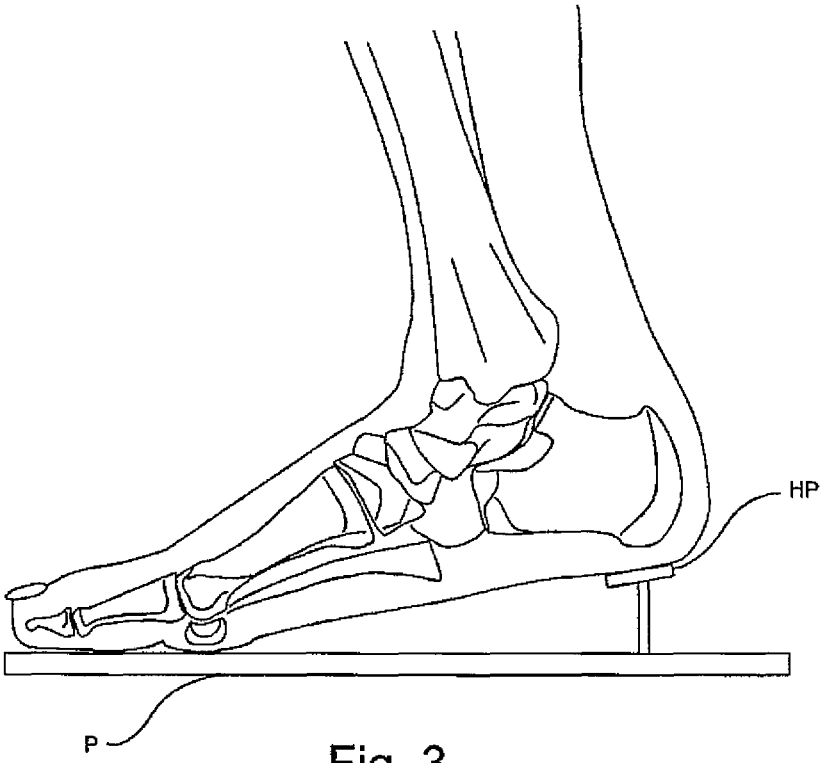
Figure 4:
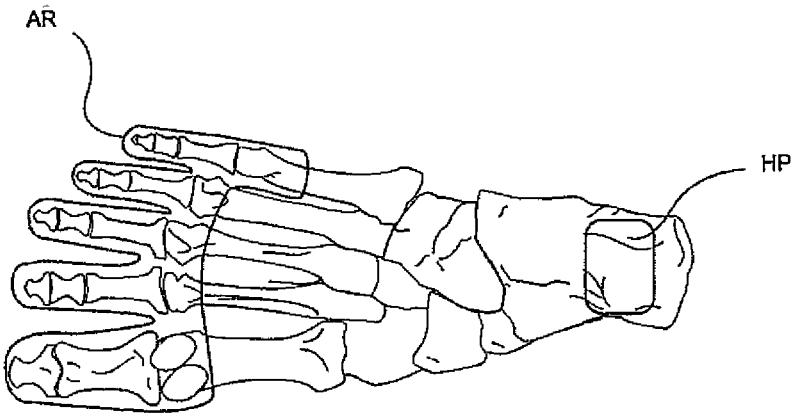

There is provided a bi-planar surface for the plantar aspect of the foot. This surface consists of a structure having not more than two discrete aspects set in different planes each aspect for contacting at least a portion of the plantar surface of the foot of a user, the first aspect being a mono-planar surface disposed under and for contact with the plantar surface at an area AR underlying the bases of the five metatarsals and associated phalanges including at least a portion of the shaft of the fifth metatarsal of the foot of a user, but excluding the portion of the plantar aspect of the foot underlying-the calcaneus with a second aspect disposed above the plane of the first aspect for contact with at least a portion of the plantar aspect of the foot underlying the calcaneus. This is shown in FIGS. 3 and 4.

The footwear may have a lateral elastomeric lateral element. In particular, footwear fabricated of material with an elastic modulus, which has at least one aspect disposed on the lateral aspect of the foot in contact with a least a portion of the shaft of the fifth metatarsal and which extends forwardly to the proximate anterior aspect of the associated phalange, consisting of a continuous panel of material having a greater elastic modulus than the material of which the footwear is generally comprised.

Although the invention for enabling the user to control the maximum height of the arch of the foot is suitable for use without a liner/footwear element the invention provides for the addition of a liner/footwear element having sufficient structure to differentiate it from a sock. Any form of liner/footwear element used in combination with any device that enables the user to control the maximum height of the arch of the foot falls within the scope of the invention.

The ability of the user to control of the maximum height of the arch of the foot is the key point, while the elements to achieve this can vary. The elements include:

a) Dorsal element D b.) Heel element H c) Plantar element P

These elements are designed and configured to create a device that provides a precise three-dimensional interface between the foot and a reaction force or appliance attached to the device. It does this by enabling the user to control the maximum height of the arch of the foot by providing three-dimensional control of the foot using a minimum of three elements: the dorsal element, the heel element and the plantar element. That is, it also provides a means of aligning the position of the foot so as to create an efficient transfer of force from the shank through the structures of the foot to a bicycle pedal or other external element.

The inclined heel element, in itself, is a key structure.

The arrangement herein therefore provides a device to enable the user to control the maximum height of the arch of the foot. A device consisting of a single, structure having not more than two elements for contact with the foot of a user, a first element disposed on the plantar aspect of the foot and a second element disposed on the dorsal aspect of the foot, the two elements configured with each other so that when the foot of a user is operationally engaged in the device the user is able to control the maximum height of the arch of the foot.

In operation, an adjustment means operated by the user enables the user to adjust the dimension between the plantar and dorsal elements of the invention until the desired maximum height of the arch of the foot is achieved.

That is the maximum height of the arch of the foot is maintained by the elements at a value less than that when the foot is un-weighted.

An inclined rear stop element is provided for the posterior aspect of the heel of a user. The element consists of a substantially mono-planar structure inclined slightly forwardly of the vertical for contact with at least a portion of the posterior aspect of the heel of a user, said device affixed to the plantar element, the inclined aspect of the device being angled anteriorly less than ninety degrees but greater than forty-five degrees in relation to the transverse aspect of the plantar element at the point of attachment. An angle in the range 75 to 85 degrees is preferred.

The plantar aspect of the foot can include a bi-planar surface where a base element having not more than two discrete aspects is set in different planes, each aspect for contacting at least a portion of the plantar surface of the foot of a user, the first aspect being a mono-planar surface for contact with plantar surface underlying the bases of the five metatarsals and associated phalanges including at least a portion of the anterior aspect of the lateral aspect of the fifth metatarsal of the foot of a user but excluding the portion of the plantar aspect of the foot underlying the base of the calcaneus with a second mono-planar aspect disposed above the plane of the first aspect for contact with at least the portion of the plantar aspect of the foot underlying the base of the calcaneus.

The plantar element can be formed of two plane aspects at an angle with each other as shown in FIG. 6 or can include a single plane as in FIG. 8. The footwear can include an elastic lateral element E, as shown in FIG. 10, with an elastic modulus, which has at least one aspect disposed on the lateral aspect of the foot in contact with a least a portion of the fifth metatarsal and which extends forwardly from a rear edge E1 at the proximate anterior aspect of the associated phalange. The element E consists of a continuous panel of material having a greater elastic modulus than the material of which the footwear is generally comprised.

The arrangement provides a combination of Maximum Arch Height Control Means and Liner/Footwear. That is, there is provided a device for enabling a user to control the maximum height of the arch of the foot in combination with footwear having sufficient structure to differentiate it from the structure of a sock.

The sketches of FIGS. 12A to 12G show the schematic arrangement of FIGS. 6 and 7 arranged in pairs to show the construction of the base unit in association with elements worn on the foot of the user.

Figure 12A:
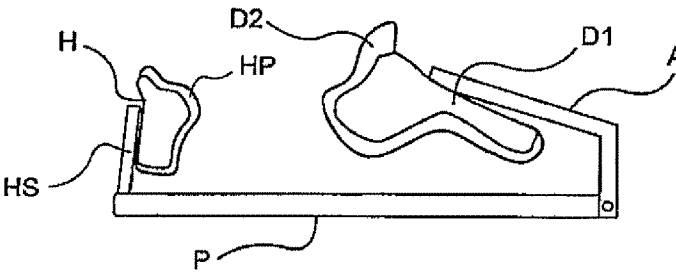
FIGS. 12A to 12G show further illustrations of the embodiment of FIGS. 8 and 9.

Thus FIG. 12A shows the base unit where the user is barefoot inside the base unit. In this case the channel shaped dorsal element D1 includes padding D2 on the underside for engaging the skin of the user and the heel cup H mounted on the inclined heel stop HS has padding HP.

Figure 12B:
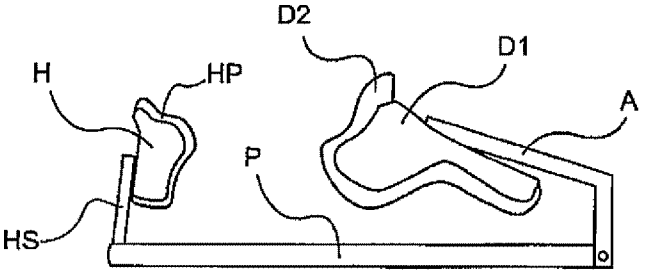
Figure 12C:
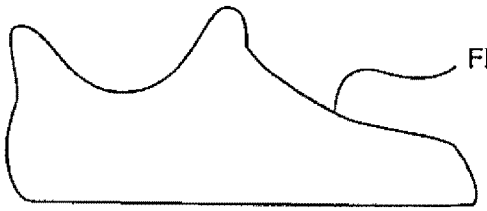

Thus FIGS. 12B and 12C shows the base unit used where the user wears minimal footwear FM inside the base unit. In this case the channel shaped dorsal element D1 includes the padding D2 on the underside for engaging the skin of the user and the heel cup H mounted on the inclined heel stop HS has the padding HP. Thus the unit comprises an exoskeleton with the secondary elements D1 and H cooperating with the base P both including the padding HP and D2.

Figure 12D:
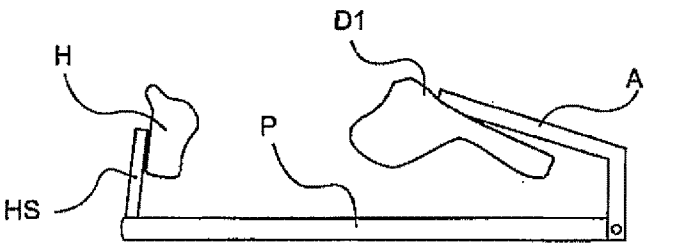
Figure 12E:
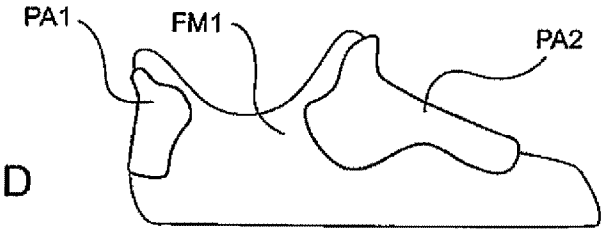

Thus FIGS. 12D and 12E shows the base unit used where the user wears pads PA1 and PA2 on the footwear FM1 which is then inserted inside the base unit. In this case the channel shaped dorsal element D1 includes no padding D2 and the heel cup H has no padding. In this case the hard elements D1 and H are mounted on the exoskeleton of the base unit.

Figure 12F:
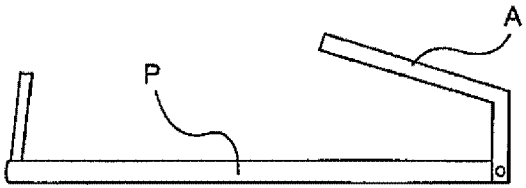
Figure 12G:
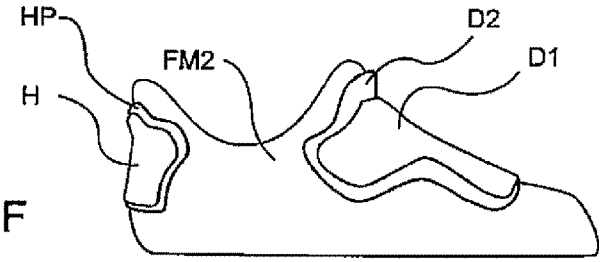

Thus FIGS. 12F and 12G shows the base unit used where the user wears footwear FM2 inside the base unit. In this case the channel shaped dorsal element D1 includes the padding D2 and the heel cup H mounted on the inclined heel stop HS has the padding HP all of which are mounted on the footwear FM2. Thus the base unit comprises the exoskeleton only with the arm A which is adjustable and supported so that it engages the element D1 on the foot wear to hold the arch under compression as described above.

In FIG. 10 is shown a schematic representation of the invention with a footwear liner system in the outer frame forming the exoskeleton. An open area in the liner on the lateral border illustrates the location of the elastomeric lateral panel E that will expand laterally in response to lateral forces acting on it with the panel E being incorporated into the liner.

Figure 10A:
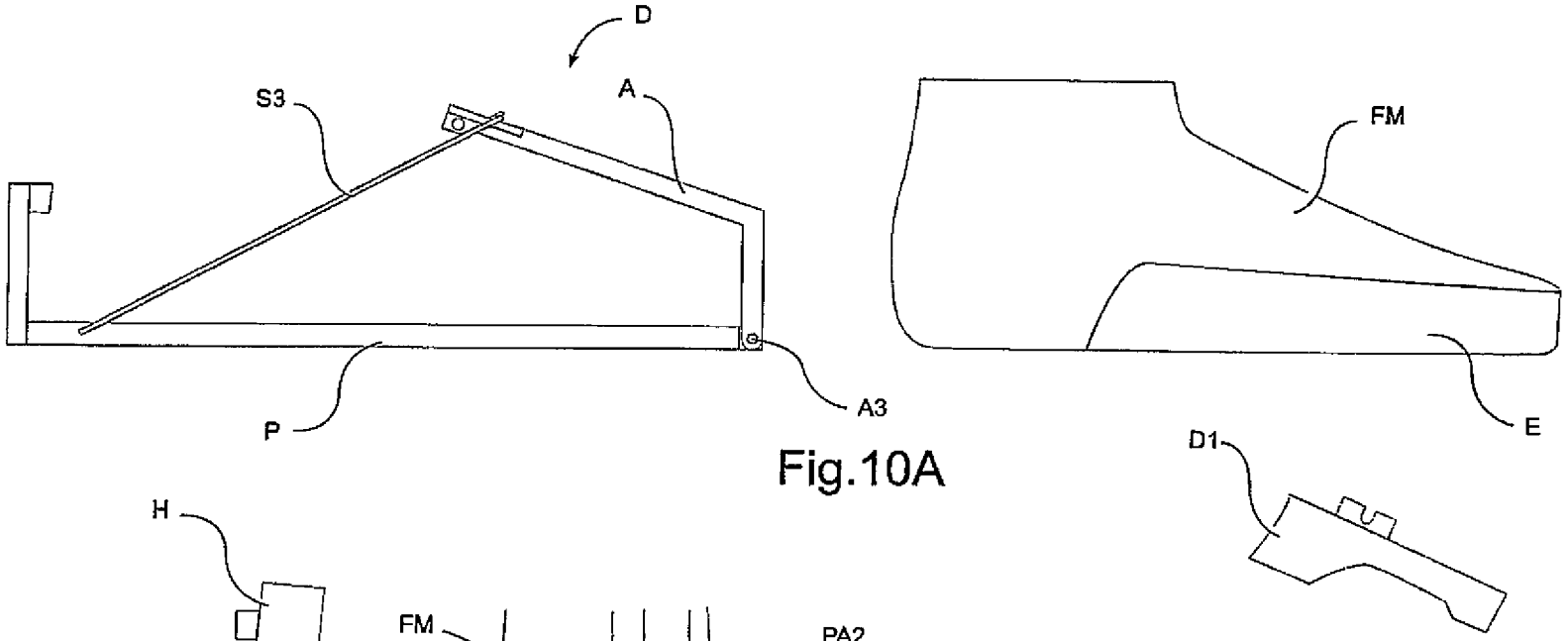
FIG. 10A is an exploded view of the embodiment of FIG. 6.
Figure 10:
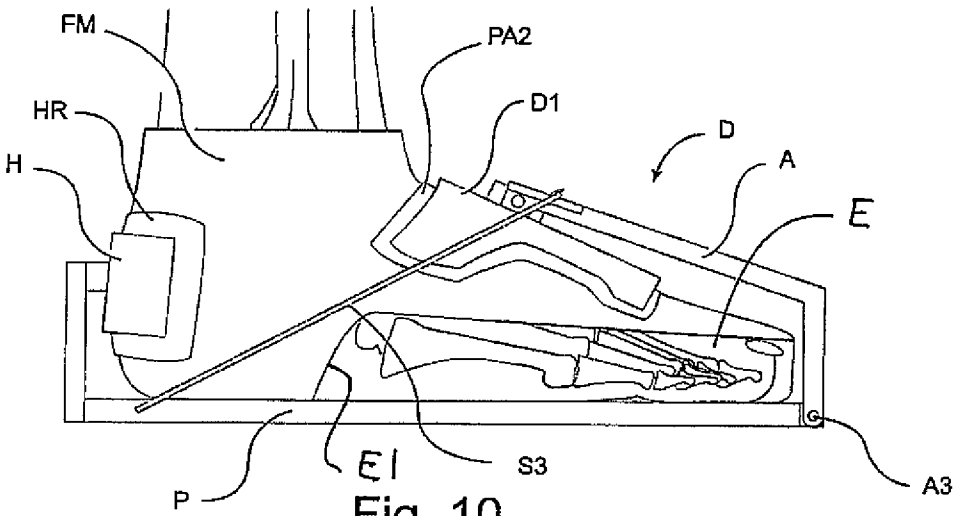
FIG. 10 is a side elevational view of the embodiment of FIG. 6.

FIG. 10A shows an exploded view of the elements of the exoskeleton and the footwear liner system with the elastomeric panel E incorporated into the liner.

Figure 11:
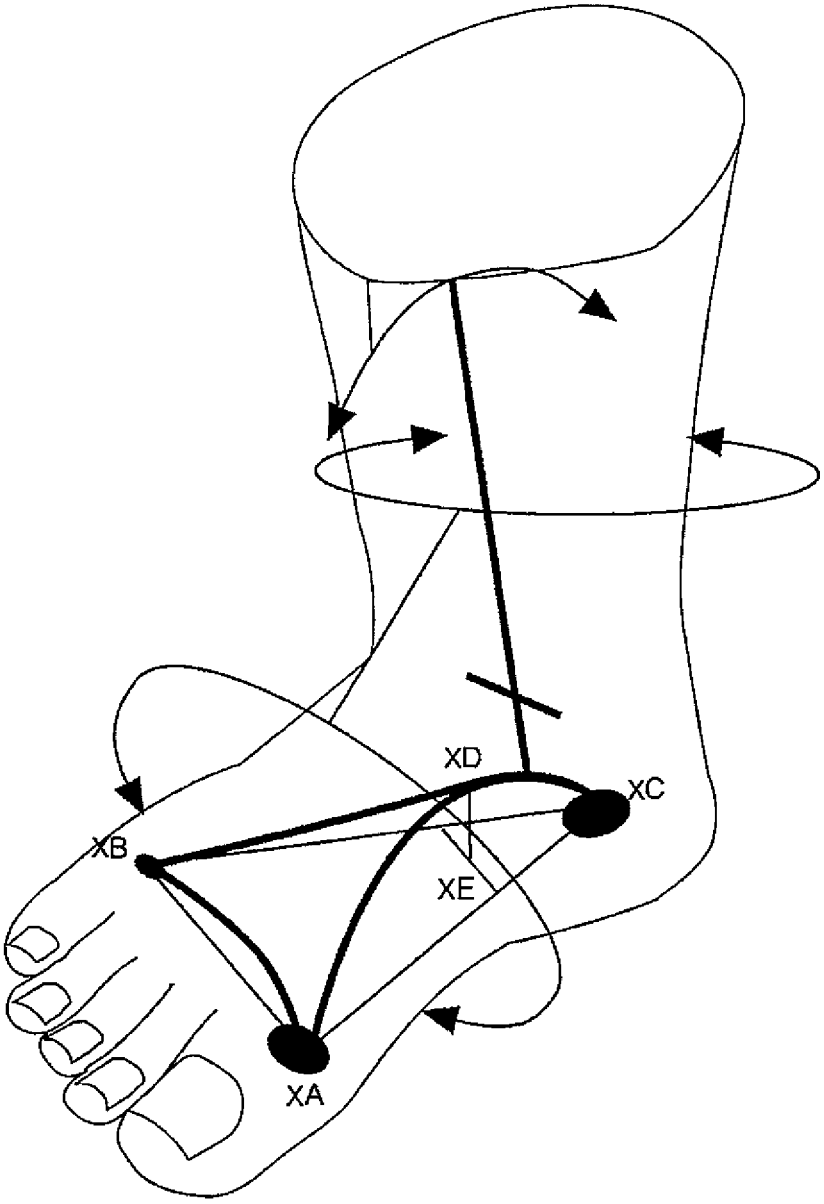
FIG. 11 is a conventional illustration identifying the height of the arch of the foot according to the definition contained herein.

The operation is shown in FIG. 11. The base of the three-dimensional quasi-truss structure that forms the vault of the arch of the foot is shown where area XA is the plantar aspect of the foot under the base of the head of the first metatarsal, area XB is the plantar aspect of the foot under the base of the head of the fifth metatarsal and area XC is the plantar aspect of the foot under the base os calcis of the calcaneus or heel bone. These three points XA, XB and XC form a plane that acts as a reference for measuring the height of the vault of the arch. The proximate apex of the arch is shown at XD where XD represents the superior surface of the dorsal aspect of the foot above the mid tarsal bone. The height of the arch as measured from the apex XD to the closest point on the base plane XA, XB, XC is shown at XD, XE.

In terms of laxity in the joints that form the vault of the arches of the foot, there is a direct relationship between the dimension XD-XE and laxity, wherein as XD-XE increases there will be a corresponding increase in laxity and wherein as XD-XE decreases there will be a corresponding decrease in laxity.

Medial, lateral and anterior structures can be provided where appropriate in relation to the management of the function of the foot and the provision of means intended to protect the foot from mechanical injury. Such structures may be strategically placed on the lateral or medial aspects or on both aspects as well as on the anterior (front) aspect of the exoskeleton and/or the associated footwear of the invention.

The means for enabling the user to control the maximum height of the arch of the foot provided herein thus provides the means to manage the degree of rigidity of the arch as appropriate for the intended application of the lower limbs.

Since various modifications can be made to the invention as herein described, and many apparently widely different embodiments of same made within the spirit and scope of the claims without departing from such spirit and scope, it is intended that all matter contained in the accompanying specification shall be interpreted as illustrative only and not in a limiting sense.

The invention claimed is:

1. A method for maintaining an optimal arch of a user's foot; the method comprising:

providing footwear that includes a base unit having a dorsal element, a heel element, a fixed bar, and a plantar element; wherein the dorsal element is located between the fixed bar and the plantar element of the footwear and is adjustable from a nonengaged position to an engaged position; wherein, in the nonengaged position, the dorsal element is spaced a first distance from the plantar element; wherein, the footwear is (1) sized to be mounted in the nonengaged position on a user's foot between the dorsal element and the plantar element, and (2) sized to optimize an arch with the dorsal element moved into the engaged position; wherein the heel element comprises an inclined rear stop that is inclined anteriorly less than ninety degrees but greater than forty-five degrees to prevent a heel of the user's foot from moving rearward or prevents the arch from collapsing;

adjusting the dorsal element to the engaged position with the dorsal element spaced a second distance from the plantar element; wherein the second distance is less than the first distance; wherein the fixed bar is connected to the dorsal element and a position of the dorsal element is adjustable with respect to the fixed bar; wherein the dorsal element is inelastic and incompressible to stabilize the footwear in the engaged position.

2. The method according to claim 1 wherein the footwear is configured to engage a pedal or crank of a cycle.

3. The method according to claim 1 wherein the dorsal element is pivotal about the plantar element.

4. The method according to claim 1 wherein the dorsal element includes a component that is adjusted along a rotatable axis.

5. The method according to claim 1 wherein the dorsal element provides a non-compliant positional element that stabilizes the anterior, posterior, and superior aspects of the user's foot.

6. A method of managing a height of an arch of a user's foot; the method comprising:

providing footwear that includes a base unit having a dorsal element, a heel element, a fixed bar, and a plantar element; wherein the dorsal element is located between the fixed bar and the plantar element of the footwear and is adjustable at least from a nonengaged position to an engaged position; wherein the dorsal element is spaced from the plantar element a first distance in the nonengaged position; wherein the heel element comprises an inclined rear stop that is inclined anteriorly less than ninety degrees but greater than forty-five degrees to counteract the reactionary force from the longitudinal arch when force is applied onto or by the user's foot the reactionary force from the longitudinal arch when force is applied onto or by the user's foot;

moving the dorsal element to the engaged position with the dorsal element a second distance from the plantar element; wherein the fixed bar is connected to the dorsal element and a position of the dorsal element is adjustable with respect to the fixed bar; wherein the second distance is less than the first distance;

wherein the dorsal element is inelastic and incompressible to stabilize the dorsal element in the engaged position and wherein, in the engaged position, the footwear is sized to optimize height and stiffness of an arch of a user's foot when disposed between the dorsal element and the plantar element.

7. The method according to claim 6 wherein the footwear is configured to engage a pedal or crank of a cycle.

8. The method according to claim 6 wherein the dorsal element is pivotal about the plantar element.

9. The method according to claim 6 wherein the dorsal element is adjusted along a rotatable axis that acts to move the dorsal element from the nonengaged position to the engaged position.

10. The method according to claim 6 wherein the dorsal element in the engaged position is configured to hold the arch at a desired arch height when force is applied by the user's foot during the process of collapse or growth of the arch.

11. A method of managing a height of an arch of a user's foot in a fixed position; the method comprising:

providing footwear having a base unit including a dorsal element, a heel element, a fixed bar, and a plantar element; wherein the dorsal element is adjustable at least from a nonengaged position to an engaged-position; wherein the dorsal element is located between the fixed bar and the plantar element of the footwear and is spaced from the plantar element a first distance in the nonengaged position; wherein a void is created between the dorsal element and the plantar element with the dorsal element in the nonengaged position; wherein the void has a volume; wherein the plantar element includes a bi-planar surface with a first aspect and a second aspect, the second aspect angled above the plane of the first aspect and such that the second aspect is elevated toward the heel element and is configured for contact with at least a portion of a planar aspect of the foot underlying the calcaneus;

moving the dorsal element to the engaged position inside the base unit with the dorsal element a second distance from the plantar element; wherein the second distance is less than the first distance; wherein the fixed bar is connected to the dorsal element and a position of the dorsal element is adjustable with respect to the fixed bar; wherein the volume of the void is reduced by the moving of the dorsal element; wherein the dorsal element is inelastic and incompressible to stabilize the dorsal element in the engaged position and wherein, in the engaged position, the footwear is sized to manage an arch of a user's foot when disposed in the void between the dorsal element and the plantar element.

12. The method according to claim 11 wherein the footwear is configured to engage a pedal or crank of a cycle.

13. The method according to claim 11 wherein the dorsal element is pivotal about the plantar element.

14. The method according to claim 11 wherein the dorsal element is adjusted along a rotatable axis to dispose the dorsal element in the engaged position.

15. The method according to claim 11 wherein the dorsal element provides a non-compliant positional element that, in conjunction with the heel element and the plantar element, stabilizes plantar and anterior-inferior of the user's foot.

16. A method of configuring a structure of footwear for managing an arch of a user's foot; the method comprising:

providing footwear having a base unit including a dorsal element, a heel element, a fixed bar, and a plantar element; wherein the dorsal element is located between the fixed bar and the plantar element of the footwear and is adjustable from a nonengaged position to an engaged position; wherein the dorsal element is spaced from the plantar element a first distance in the nonengaged position; wherein the footwear is adapted to receive a user's foot in a relaxed position between the dorsal element and the plantar element; wherein the heel element comprises an inclined rear stop that is inclined anteriorly less than ninety degrees but greater than forty-five degrees to prevent a heel of the user's foot from moving rearward;

moving the dorsal element to the engaged position with the dorsal element a second distance from the plantar element; wherein the second distance is less than the first distance; wherein the fixed bar is connected to the dorsal element and a position of the dorsal element is adjustable with respect to the fixed bar;

wherein, after the moving, the dorsal element is stabilized in the engaged position and the footwear is adapted to allow the user's foot to function in a defined space.

17. The method according to claim 16 wherein the footwear is configured to engage a pedal or crank of a cycle.

18. The method according to claim 16 wherein the dorsal element is pivotal about the plantar element, prevents the user's foot from moving upward, and manages growth of the user's arch.

19. The method according to claim 16 wherein the dorsal element includes a component that is adjusted by a along a rotatable axis.

20. The method according to claim 16 wherein the dorsal element in the engaged position is configured to hold the arch at a desired arch height which counteracts the force from the arch when maintained in the engaged position.

* * * * *